United States Patent [19]

Dal Negro

[11] 4,011,895

[45] * Mar. 15, 1977

[54] TAPE-SUPPORTED SLIDE FASTENER ELEMENT

[76] Inventor: Ruggero Dal Negro, Via Cusani 10, Milan, Italy

[ * ] Notice: The portion of the term of this patent subsequent to Mar. 15, 1993, has been disclaimed.

[22] Filed: Sept. 14, 1972

[21] Appl. No.: 289,063

[30] Foreign Application Priority Data

May 9, 1972 Italy ..... 24080/72

[52] U.S. Cl. ..... 139/384 B; 24/205.16 C

[51] Int. Cl.[2] ..... D03D 1/00; A44B 19/00

[58] Field of Search ..... 24/205.1 R, 205.1 C, 24/205.15, 205.16 R, 205.16 C, 205.13 C; 139/384 R, 384 B

[56] References Cited

UNITED STATES PATENTS

| | | | |
|---|---|---|---|
| 3,022,803 | 2/1962 | Berberich et al. | 139/384 B |
| 3,454,052 | 7/1969 | Burbank | 139/384 B |
| 3,487,511 | 1/1970 | Frohlich | 139/384 B |

*Primary Examiner*—Henry S. Jaudon
*Attorney, Agent, or Firm*—Karl F. Ross; Herbert Dubno

[57] ABSTRACT

A slide-fastener element of the monofilamentary-coil type rests on a stringer tape whose main portion lies in a plane offset from the midplane of the coil. The tape, woven from a set of main warp threads and a continuous weft thread, is anchored to the coil by two sets of ancillary warp threads which respectively overlie and underlie a core traversing the turns of the coil and are interlinked by the same weft thread, the latter also passing around the core. The underlying ancillary warp threads are coplanar with the main warp threads; the overlying ancillary warp threads are more numerous than the underlying ones and envelop about half the coil from above.

4 Claims, 20 Drawing Figures

A
N
N2
N1
T
T'
T''
T'''
T IV
T V
T VI
S
S'
C
O
1 2 3 4 5 6 7 8 9
1' 2' 3' 4' 5'

A
N
N1
N2
T
T'
T''
T'''
TIV
TV
TVI
S
S'
O
1 2 3 4 5 6 7 8 9
1' 2' 3' 4' 5'

TAPE-SUPPORTED SLIDE FASTENER ELEMENT

My present invention relates to a slide fastener of the type wherein, in each of its halves, a coiled fastener element (preferably of the monofilamentary polymeric type) is interwoven with textile threads or other filaments constituting a stringer tape.

In my copending applications Ser. Nos. 21,778, filed Mar. 23, 1970, and now abandoned, and 201,738, filed Nov. 24, 1971 as a continuation-in-part of the former, I have disclosed a slide fastener of this nature whose coupling coils are individually secured to a pair of woven stringer tapes by two sets of ancillary warp threads respectively underlying and overlying the coil, these ancillary warp threads extending parallel to the coil axis and being interlinked by a continuous weft thread also connecting them with the main warp threads of the tape body. A core, which may be a single cord or a bundle of filaments substantially heavier than the warp threads, passes longitudinally through the turns of the coil of each fastener half and is engaged by the weft thread on the side remote from the tape body, i.e. the side of the coupling heads which are formed on the turns of the coil and serve to engage corresponding coupling heads of the coil of the other fastener half.

In the slide fastener described and illustrated in these earlier applications, in conformity with conventional practice, the body of the stringer tape lies symmetrically with reference to the coil in a midplane of the latter, more specifically in the plane of the major axes of the generally elliptical turns thereof. This arrangement also calls for a substantially symmetrically constructed slider whose two halves are guided by upper and lower beads that are defined on each stringer tape by the two sets of ancillary warp threads which rest on the upper and lower coil surfaces. Thus, the height of each bead above the tape body is slightly less than half the combined height of the coil and its enveloping ancillary warp threads.

The guidance afforded by these relatively low beads, while sufficient in many instances, is not satisfactory if the fastener is of the heavy-duty type, e.g. as used on suitcases, boots and other articles which must be closed with considerable force. Under such circumstances the advancing slider may not exert enough lateral pressure upon the two coils to insure the correct interlocking of all their turns; even one missed linkup may cause the fastener halves to come apart prematurely.

The object of my present invention, therefore, is to provide an improved slide fastener of the character set forth which, without being bigger or more complex than those of my two prior applications, avoids the aforestated drawback and is particularly adapted for heavy-duty use.

This object is realized, in accordance with my present invention, by disposing the body of each stringer tape in a plane parallel to the midplane of its coil but offset therefrom to an extent sufficient to let at least a major portion of each turn of a coil (including its coupling head) lie above the plane of the tape body, thereby providing an unsymmetrical structure for each fastener half wherein the upper half of the associated slider is positively guided by a bead whose height substantially equals that of the coil. The terms "upper" and "lower" as well as "above" and "below" are, of course, to be understood in a relative sense only and could be interchangeable; in most cases, though, the "upper" half of the slider is the one that is more easily accessible and carries the handle by which the slider can be pulled.

The structure of the tape body is not critical but advantageously, for simplicity of manufacture (e.g. with the aid of a needle loom as described in my prior U.S. Pat. No. 3,480,045), includes a set of main warp threads interlinked by a single weft thread with two sets of ancillary warp threads in the manner disclosed in my two above-identified copending applications; one set of ancillary warp threads, referred to hereinafter as first warp threads, closely underlie a longitudinal segment of the coil in the plane of the main warp threads whereas the other set of ancillary warp threads, referred to hereinafter as second warp threads, hug the side of the coil opposite its coupling heads and closely overlie the longitudinal coil segment which preferably encompasses about one half of each turn thereof. The anchoring of the stringer tape to the coil is again accomplished by passing the weft thread between its turns around an inserted core on the side thereof proximal to the coupling heads.

It will be convenient to make the second warp threads more numerous than the first ones in order to allow for a substantially uniform spacing of all the ancillary warp threads on three sides of the coil.

Like the assembly of coil and stringer tape of my improved slide fastener, the associated slider also has an unsymmetrical structure. In a preferred embodiment, its lower half is a substantially flat base plate whereas its upper half is a shell accommodating the two interlinked coils and their overlying "second" warp threads. The sidewalls of the shell, separated from the base plate by gaps which are traversed by the stringer-tape bodies, can thus be of substantially the same height as the coils so as to bear upon the latter at the narrow vertices of its more or less elliptical turns with a force lying generally within the aforementioned midplane.

The above and other features of my invention will be described in detail hereinafter with reference to the accompanying drawing in which.

Figure 1:
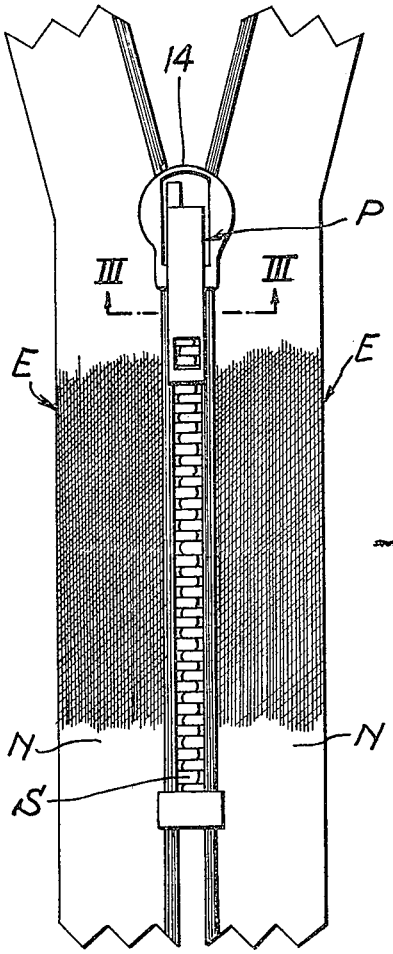
FIG. 1 is a top plan view of a slide fastener embodying my invention.
Figure 2:
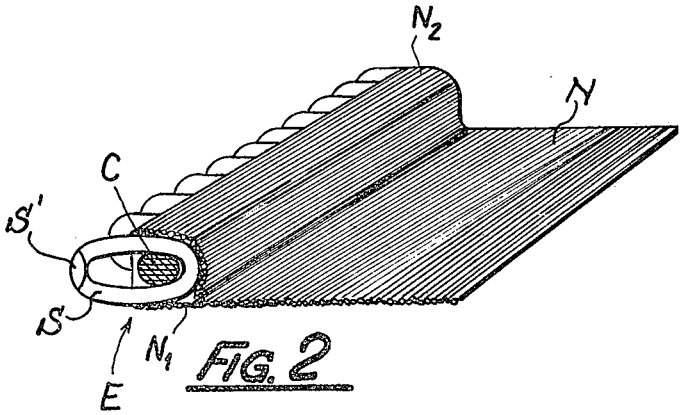
FIG. 2 is a perspective view of one of the halves of the slide fastener shown in FIG. 1.

In FIG. 1 I have shown a slide fastener according to my invention whose two mirror-symmetrical halves E are held together by a slider P. Each slide-fastener half E, as best illustrated for one of these halves in FIG. 2, comprises a tape N whose body rises in plane tangent to the underside of a coil S having coupling heads S′ remote from the tape on the turns of coil S. These turns are generally elliptical, with the major axes of the ellipses lying in a midplane *m* (FIG. 3) parallel to the plane of the body of tape N. The coil S may consist of monofilamentary thermoplastic material such as nylon as conventionally used in such fasteners. A core C, e.g. in the form of a heavy textile cord, passes longitudinally through the turns of each coil S on the side next to the tape body. The half of the coil occupied by the core C is bracketed by a lower extension $N_1$ and an upper extension $N_2$ of this tape body as more fully described hereinafter with reference to FIGS. 4 – 19.

Figure 3:
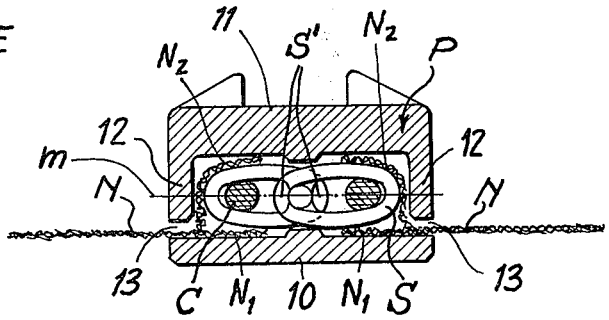
FIG. 3 is a cross-sectional view taken on the line III — III of FIG. 1 and showing the slider of the fastener on an enlarged scale.
Figure 3A:
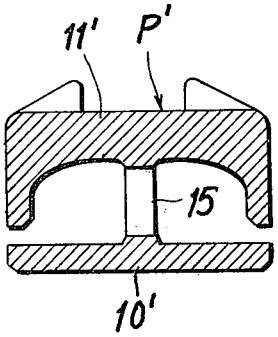
FIG. 3A is a view similar to FIG. 3, illustrating a modified slider.

The slider P, as shown in FIGS. 3, comprises a flat base plate 10 and a shell 11, the latter having sidewalls 12 which are separated from the base plate 10 by gaps 13 giving passage to the two tapes N. The height of each sidewall 12 corresponds approximately to that of the coil S whereby these coils, together with their overlying tape portions $N_2$, are received in the interior of shell 11. The shell and the base plate are held together in the usual manner, at the front end of the slider P, by a post 15 (see FIG. 3A). Slider P also has a looped handle 14 (FIG. 1).

The slider P of FIG. 3 bears upon each coil S at isolated points only, i.e. upon the underside thereof through the lower tape portion $N_1$ and upon its top and lateral surfaces through the upper tape portion $N_2$. It is possible, however, to design a slider P′ (FIG. 3A) with a shell 11′ of generally elliptically curved inner coutour which comes to bear (through the threads of tape portion $N_2$) over substantially the entire outer and upper quadrant of the profile of each of the two interlocked coils resting on base plate 10.

As illustrated in FIGS. 4 – 19, the body A of each tape N is woven from a set of main warp threads 0 and a continuous weft threat T interlinked therewith. Extension $N_1$ contains a relatively small number of ancillary warp threads 1′ – 5′ while strip $N_2$ contains a larger number of ancillary warp threads 1 – 9.

With the weave pattern illustrated in FIGS. 4 – 9, weft thread T interlinks all the warp threads 0, 1′ – 5′, 1 – 9 in a repetitive cycle of six strokes, each stroke forming a double pass of that thread either above or below coil S. The weft thread is also looped, between adjacent turns of coil S, around the core C on the side proximal to the coupling heads S′, thereby anchoring both the core and the coil to the fabric structure. It will be understood that during shedding, before the tightening of the preceding passes, the vertically superposed warp threads 1 – 4 are horizontally staggered so as not to get into one another's way; as the weft needle moves out to the selvedge of the fabric, these warp threads are drawn onto the coil surface so as to assume the position shown in FIGS. 2 and 3.

Figures 4, 5, 6, 7, 8, 9:
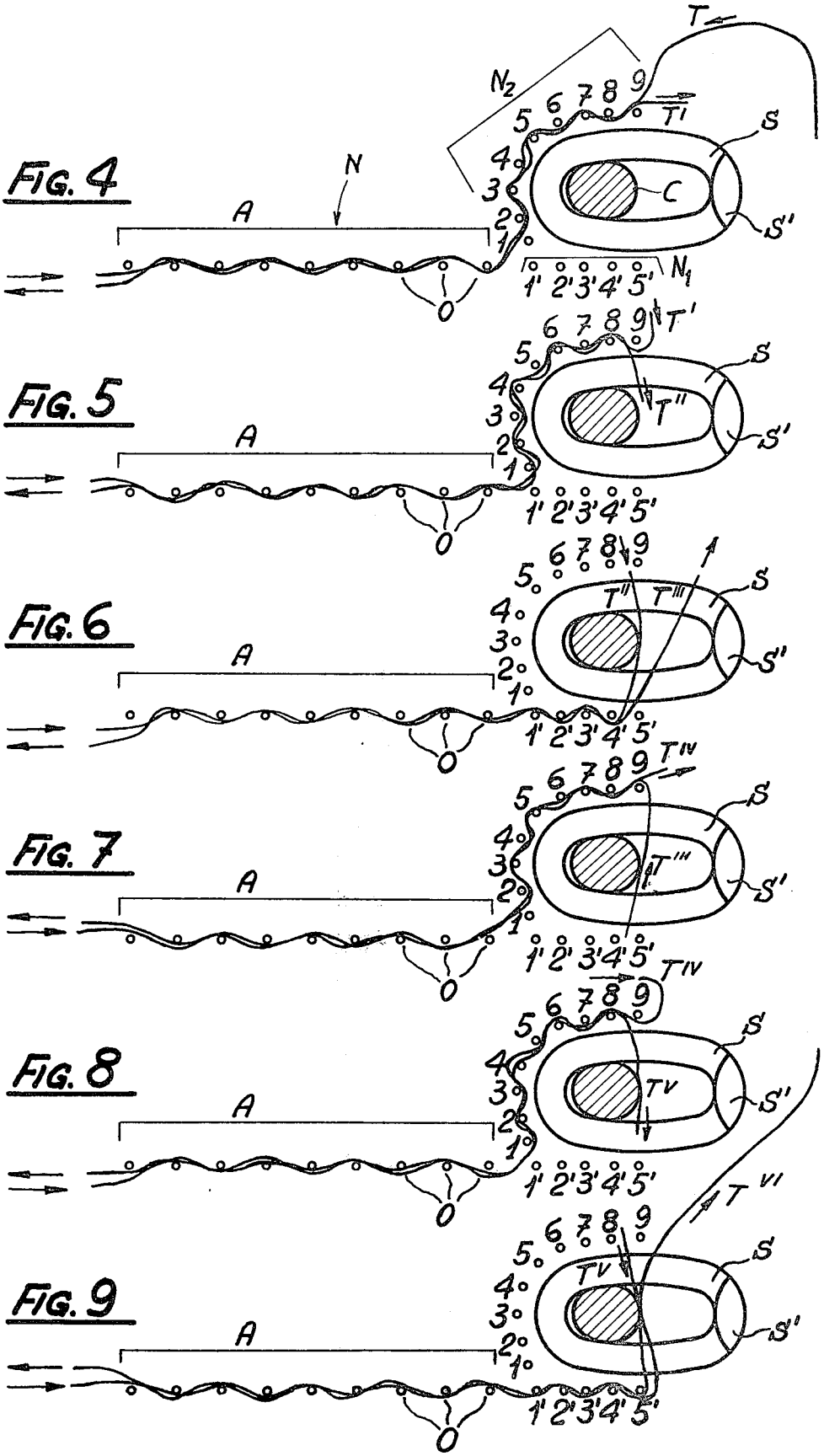
FIGS. 4 – 9 are somewhat diagrammatical cross-sectional views showing successive passes of a weft thread above and below a coil forming part of one of the fastener halves.
Figures 10, 11, 12, 13, 14, 15:
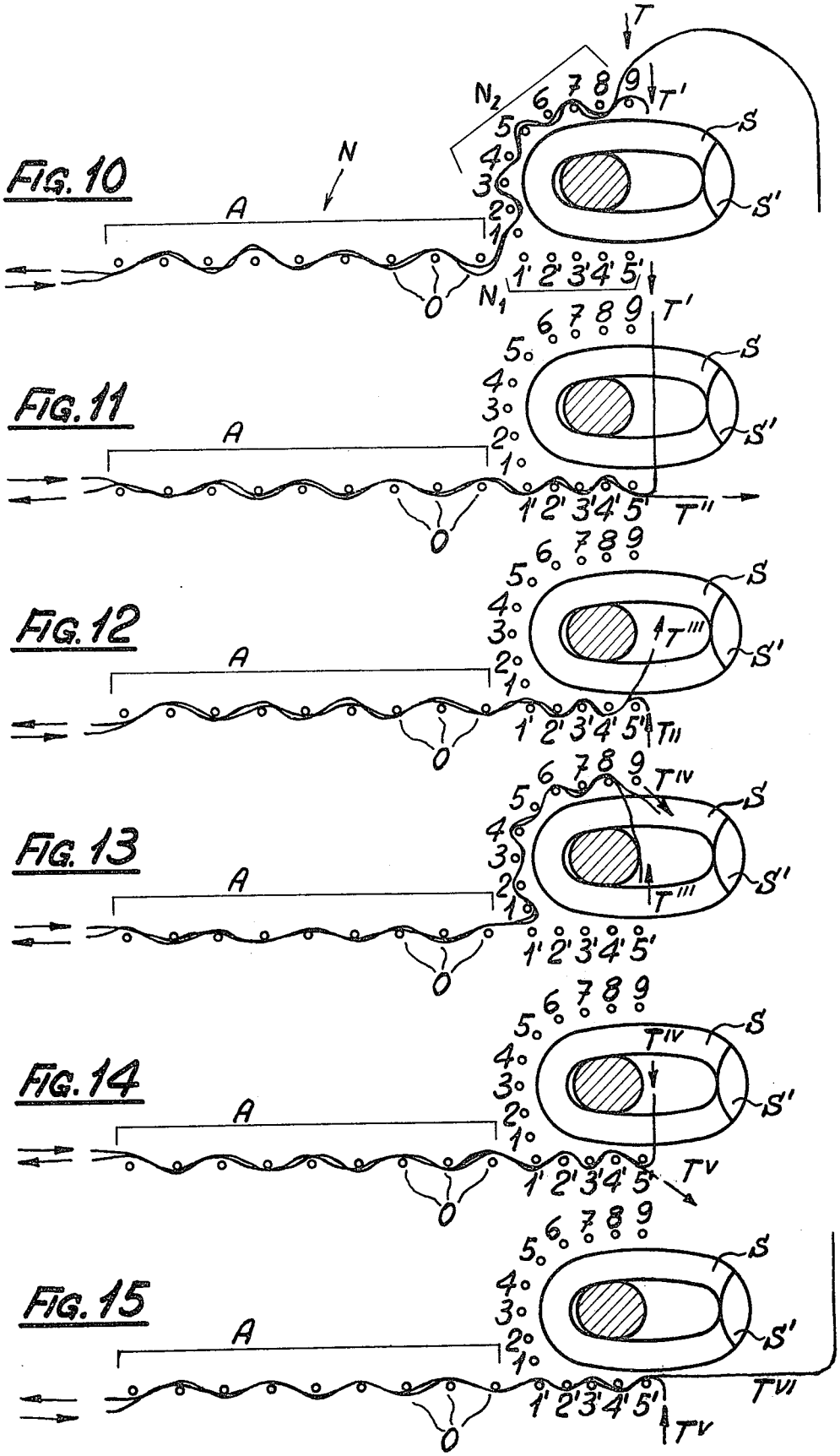
FIGS. 10 – 15 are views similar to FIGS. 4 – 9, illustrating a modified weaving pattern.
Figure 16:
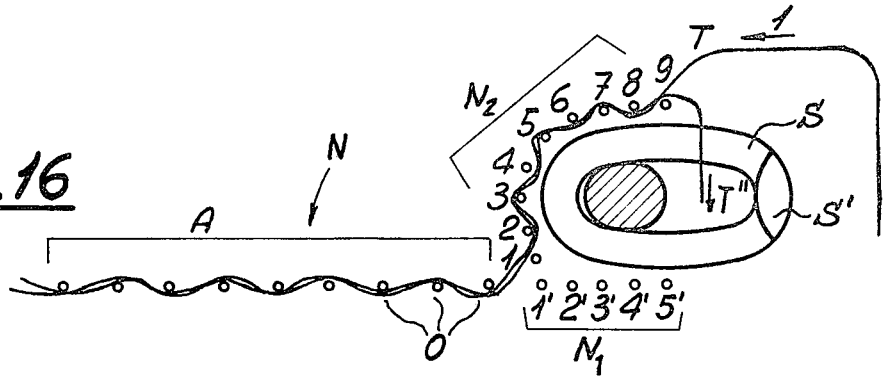
FIGS. 16 – 19 are further views similar to FIGS. 4 – 15, illustrating still another weaving pattern.
Figure 17:
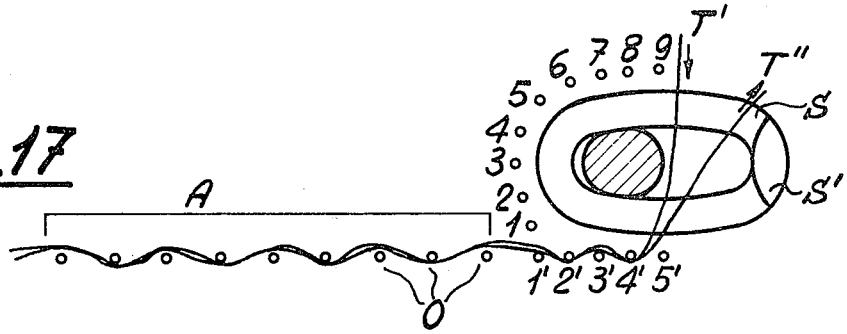
Figure 18:
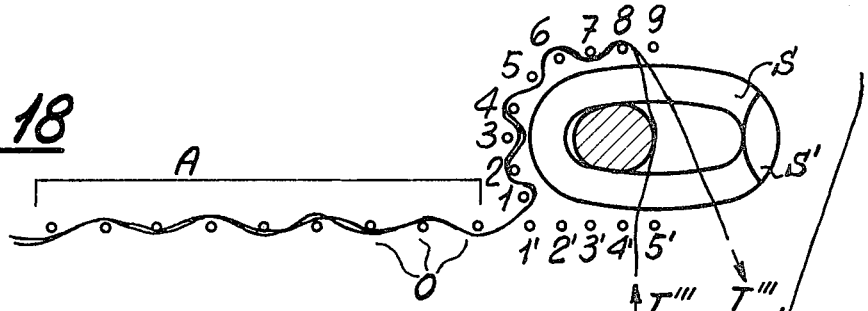
Figure 19:
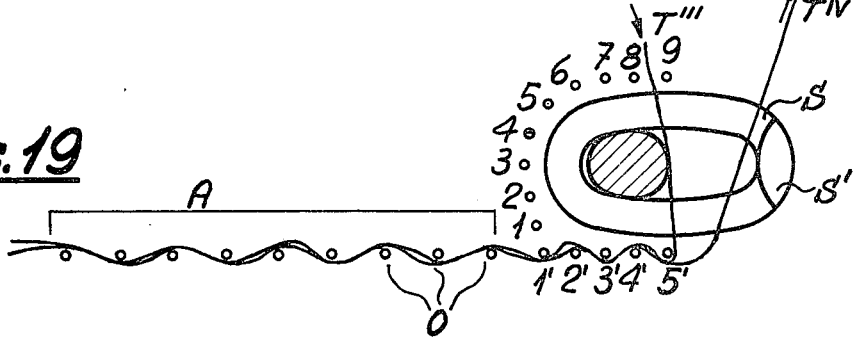

In FIG. 4 the first pass of thread T goes from right to left between the raised (even-numbered) and lowered (odd-numbered) warp threads 1 – 9 of the upper set and then through the set of main warp threads 0, returning (left to right) along the same path on the next pass which has been designated T′. Thereafter, with the lower ancillary warp threads 1′ – 5′ still not participating in the shedding, the relative position of the upper warp threads is inverted while the weft thread T′ passes from right to left and then, in a return pass T″, reverts through the same shed to the right before being looped around the core C as shown in FIG. 5. Next, according to FIG. 6, a double pass T″, T‴ interlinks the lower ancillary warp threads 1′ – 5′ and the main warp threads 0, the thread T‴ thereupon rising across the core C within the coil S as illustrated in FIG. 7. The three strokes shown in FIGS. 7 – 9 are identical with those of FIGS. 4 – 6 except for a relative inversion of the positions of the main warp threads, the weft engaging the core C in the form of passes $T^{iv}$, $T^{v}$ and $R^{vi}$ whereupon the sequence is repeated. Thus, two double passes among the upper ancillary warp threads 1 – 9 alternate with one double pass among the lower ancillary warp threads 1′ – 5′.

The several weft passes described with reference to FIGS. 4 – 9 may all be accommodated between two consecutive turns of the coil S, with the passes of the following cycle separated therefrom by the monofilament. If, however the spacing of the turns is wide with reference to the thickness of the weft thread, the passes of several cycles may follow one another within one interturn gap.

With the weave pattern of FIGS. 4 – 9, the fabric structure of the upper tape portion $N_2$ is denser than that of the lower tape portion $N_1$. This reinforces the tape portion $N_2$ which serves for the guidance of the slider P and is subjected to the greatest wear.

In FIGS. 10 – 15 I have shown a reversal of aforedescribed weave pattern in which two double passes of the weft thread among the lower warp threads 1′ – 5′ alternate with one double pass among the upper warp threads 1 – 9, again in a cycle of six consecutive needle reciprocations.

As shown in FIGS. 16 – 19, a 4-stroke cycle is possible in which the weft thread T forms double passes alternately above and below the coil S. In this case the fabric density is the same for the two tape portions $N_1$, $N_2$ and corresponds to half the density of the main body A of the tape.

If desired, the upper ancillary warp threads 1 – 9 (or some of them) could be heavier than their lower counterparts 1′ – 5′ and/or these upper warp threads could be made of a more wear-resistant material.

I claim:

1. A slide-fastener half comprising:

a fastener element in the shape of a continuous coil with spaced-apart turns provided at one side with coupling heads that are substantially bisected by a midplane of the coil;

a core extending longitudinally of said coil through said turns; and a stringer tape anchored to said coil on the side thereof opposite said coupling heads, said tape having a body disposed in a plane parallel to said midplane but offset therefrom and substantially tangent to the underside of said coil, said tape having a lower extension in said parallel plane underlying part of said coil but terminating short of said coupling heads, said tape further having an upper extension hugging part of said coil and terminating above said midplane short of said coupling heads, said tape consisting of a multiplicity of warp threads interlinked by a single weft thread, said warp threads including a set of main warp threads in said body, a set of first ancillary warp threads in said lower extension and a set of second ancillary warp threads in said upper extension, said weft thread passing around said core on the side thereof proximal to said coupling heads, said second ancillary warp threads being more numerous than said first ancillary warp threads, said first and second ancillary warp threads having substantially the same mutual spacing.

2. A slide-fastener half as defined in claim 1 wherein said weft thread forms pairs of double passes among said second warp threads alternating with individual double passes among said first warp threads.

3. A slide-fastener half as defined in claim 1 wherein said ancillary warp threads envelop at least half of each turn of said coil.

4. A slide-fastener half as defined in claim 3 wherein said turns are generally elliptical with a major axis in said midplane.

* * * * *